US006522235B2

(12) United States Patent
Cheng

(10) Patent No.: US 6,522,235 B2
(45) Date of Patent: Feb. 18, 2003

(54) SWITCH STRUCTURE FOR A HEATING DEVICE

(76) Inventor: Yu Jen Cheng, PO Box 82-144, Taipei (TW)

( * ) Notice: Subject to any disclaimer, the term of this patent is extended or adjusted under 35 U.S.C. 154(b) by 34 days.

(21) Appl. No.: 09/756,918

(22) Filed: Jan. 10, 2001

(65) Prior Publication Data

US 2002/0088489 A1 Jul. 11, 2002

(51) Int. Cl.[7] ..... H01H 37/02; H01H 37/32; G05D 23/22

(52) U.S. Cl. ..... 337/298; 337/20; 337/14; 200/12; 431/80; 361/162; 236/68 D

(58) Field of Search ..... 337/298, 299, 337/1, 2, 20; 200/12; 431/18, 42, 50, 51, 80; 361/139, 160, 162; 236/68 D, 21 R

(56) References Cited

U.S. PATENT DOCUMENTS 3,597,138 A * 8/1971 Ray ..... 137/66
3,685,730 A * 8/1972 Katchka ..... 137/614.14
3,763,875 A * 10/1973 Mobus et al. ..... 137/636.4
3,810,249 A * 5/1974 McGowan ..... 337/1
3,843,049 A * 10/1974 Baysinger ..... 236/1 E
4,267,859 A * 5/1981 Dykzeul ..... 137/550
4,285,662 A * 8/1981 Katchka et al. ..... 431/53
4,304,249 A * 12/1981 White ..... 122/448.1
5,326,029 A * 7/1994 Schultz ..... 137/66
5,484,103 A * 1/1996 Schultz ..... 137/66
6,027,335 A * 2/2000 Griffioen ..... 431/266
2001/0022198 A1 * 9/2001 Kuriyama et al. ..... 137/630.19

FOREIGN PATENT DOCUMENTS

DE 3105391 A * 9/1982 ..... F23N/5/10

* cited by examiner

*Primary Examiner*—Anatoly Vortman
(74) *Attorney, Agent, or Firm*—Leong C. Lei

(57) ABSTRACT

A switch structure for a heating device having a passage formed within the main body of the structure, an air inlet, a main flame air outlet, a second air outlet and a thermocouple insertion hole connected to the passage being formed on the main body, and a manual control rod having a stopper being provided within the passage of the main body, two through holes being formed corresponding to the main flame air outlet and the second flame air outlet; characterized in that the main flame air outlet, the thermocouple insertion hole and the second flame air outlet have upward direction openings of similar direction, and the main flame air outlet and the air inlet are located on the same axis, and a stopper is suitably mounted between the main flame outlet and the air inlet, thereby the lighting rod of the switch, the thermocouple and the second air tube are extended in same direction to form an easy assemble, safe and stable switch for the heater.

2 Claims, 7 Drawing Sheets

SWITCH STRUCTURE FOR A HEATING DEVICE

BACKGROUND OF THE INVENTION (a) Technical Field of the Invention

The present invention relates to a heating device switch, and in particular, a switch structure with a main flame air outlet, a second flame outlet and a thermocouple insertion hole having an opening facing upward.

(b) Description of the Prior Art

A conventional heating device which is used to provide heat to a room is shown in FIG. 1. The lower end of the heating device is provided with a gas tank 12 and the top end of the heating device is provided with a cylindrical housing 11. The top end opening of the gas tank 12 is connected to an air tube 13 and the middle section of the air tube 13 is provided with a switch 20. The manual control rod 26 of the switch 20 passes through the housing 10 for the operation of the user. The top end of the air tube 13 is provided with a burner 15. When t user turns on the switch 20, the gas tank 12 provides gas to produce heat, and the top end of the housing 10 is provided with an arc-shaped reflective hood 16 so as to allow heat energy to disperse downward.

The structure of he switch 20 is shown in FIGS. 2 and 3. The main body 21 of the conventional switch 20 is formed into a passage 22. The passage 22 has an air inlet 23 with an opening facing downward, and an air outlet 24 with an opening facing award and the main body 21 is formed into a second flame air outlet 25 of horizontal shape, and the second flame outlet 25 is a horizontal thermocouple insertion hole 28 with a 90 degree inclination angle. The interior of the passage 22 is mounted with a manual control rod 26, and a stopper 27 is mounted on the manual control rod 26. On the stopper 27, there are two through holes 270 corresponding to the flame outlet 24 and the second flame outlet 25 such that when the manual control rod 26 rotates, the respective holes 270 align with the main flame outlet 24 and the second flame air outlet 25. The passage 22 within the thermocouple insertion hole 28 is provided with an electromagnetic valve 29, and the electro-magnetic valve 29 is provided with a plug body 290 having a stepped, protruded edge 220 to block the step so as to block the air inlet 23 and the passage 22 between the main flame air outlet 24 and the second flame air outlet 25.

The main flame air outlet 24 is connected to the burner 15, and the air inlet 23 is connected to the gas tank 12. The second flame air outlet 25 employs a soft tube to guide the air to the surrounding of the thermocouple insertion hole 28 for the thermocouple after the electromagnetic valve 29 is in alignment (not shown). When the user presses downward and rotates the manual control rod 26, the plug body 290 of the electromagnetic valve 29 is suitably pushed, and the gas flows via the passage 22 and the through hole 270 of the stopper 27 to the main flame air outlet 24 and the second flame air outlet 25. Due to rotating of the manual control rod 26, the burner 15 is triggered and the gas from the second flame air outlet is burnt and heat is provided. The electromagnetic valve 29 attracts the plug body 290 such that the gas from the main flame air outlet 24 to the burner 15 is maintained until the manual control rod 26 is rotated to its original position. The through holes 270 do not align with the main flame air outlet 24 md the second air outlet 25, and the gas supply is cut off and the thermocouple is not heated, and the plug body 290 is restored to cut off the passage 22. This will close the burner 15.

The above conventional structure has the following drawbacks:

(1) Assemble problem the air inlet 23 and thee flame air outlet 24 are not on the same axis, and the direction of openings of the outlet 24 and the second flame air outlet 25 is different. A conversion connector 30 is employed to the main flame air outlet 24 such that the air inlet hole 23 and the man flame outlet 24 are stopped at one axis. In addition, a soft tube has to bused in order to guide gas from the outlet 25 to the thermocouple. Thus, the assemble procedures of this structure are complicated and not convenient.

(2) Passage of flow is not smooth

The design of the passage 22 within the main body 21 of the switch 20 is not appropriate. The inlet 23 and the various outlets are not at the same direction. Thus, the flow of air stream is not smooth and the complete burning of gas is affected.

(3) High cost of production in view of the above, due to the complicated assembly, or the parts of the structure more man power, time and production cost are involved and is will lower the production rate. As a result, the production cost is increased.

(4) Low safety

The safety of the structure is low for the reason that the burning of the gas is incomplete. The soft tube can be easily torn and gas will leak.

(5) Low stability

Due to the positions of the openings being not at the same direction, the weight center of the heater is biased at one side.

This will affect the stability of the heating device.

Accordingly it is a main object to mitigate the above drawbacks by providing a switch structure for a heating device.

SUMMARY OF THE INVENTION

Accordingly, it is an object of the present invention to provide a switch structure for a heating device wherein the main flame air outlet, the thermocouple insertion hole and the second flame air outlet are opened in an upward direction, and the main flame air outlet and the air inlet are located on the same axis, thereby the assemble of the lighting rod, the thermocouple and the main flame air tube is convenient, and the weight center of the heating device after the pipes are mounted will maintaining at the center point to increase the stability of the heating device.

Yet a further object of the present invention is to provide a switch structure for a heating device, wherein the guiding hole between the switch passage and the second flame outlet is provided with an adjusting screw, the adjusting screw is mounted with a sealing element which can provide air sealing, and the adjusting screw, corresponding to the second flame outlet hole, is provided with a cylindrical plug so as to control the size of air venting of second flame air outlet to achieve the object of controlling the size of the second flame.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
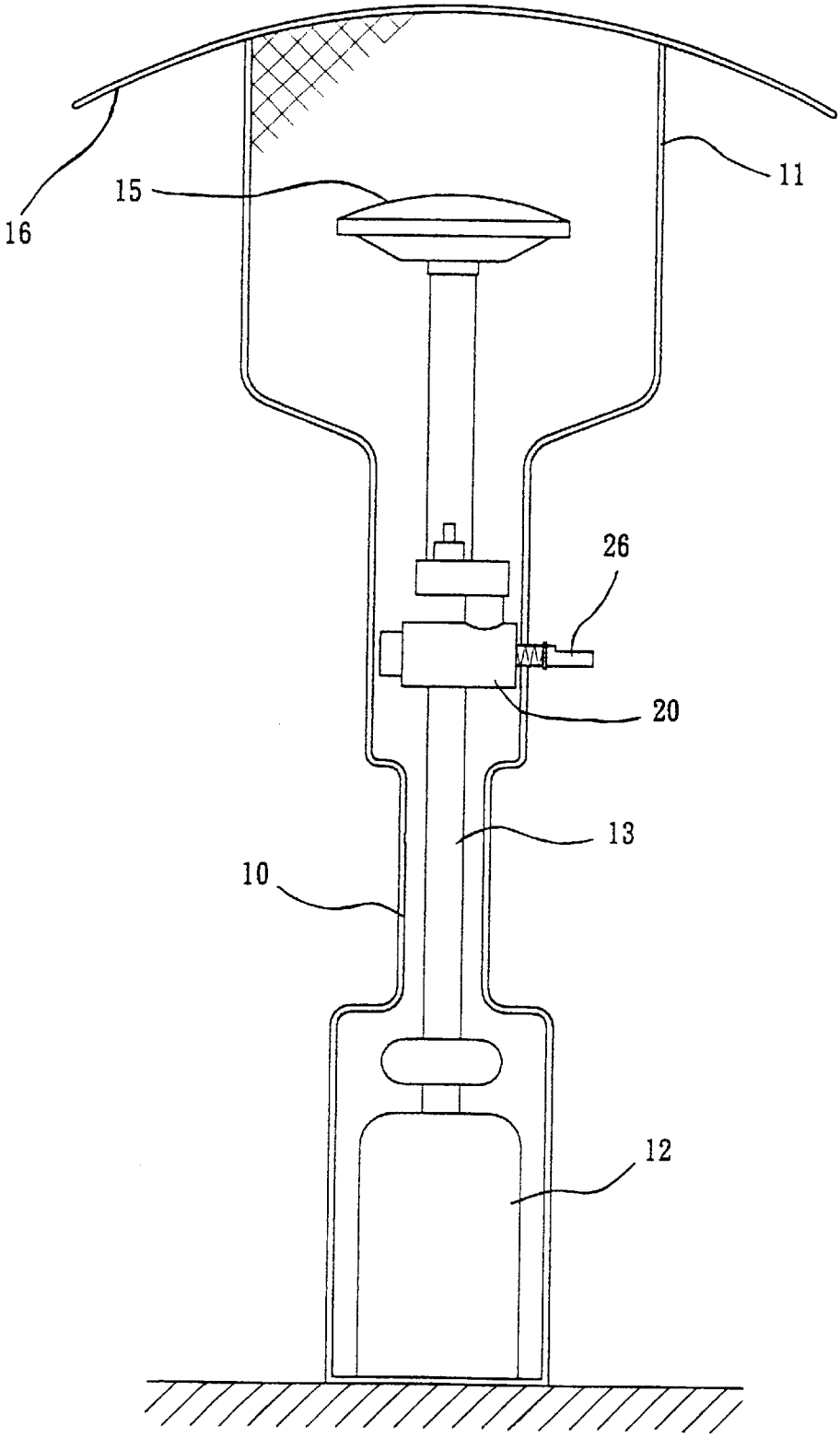
PRIOR ART FIG. 1
FIG. 1 is a schematic view of a conventional switch applied in the heating device.
Figure 2:
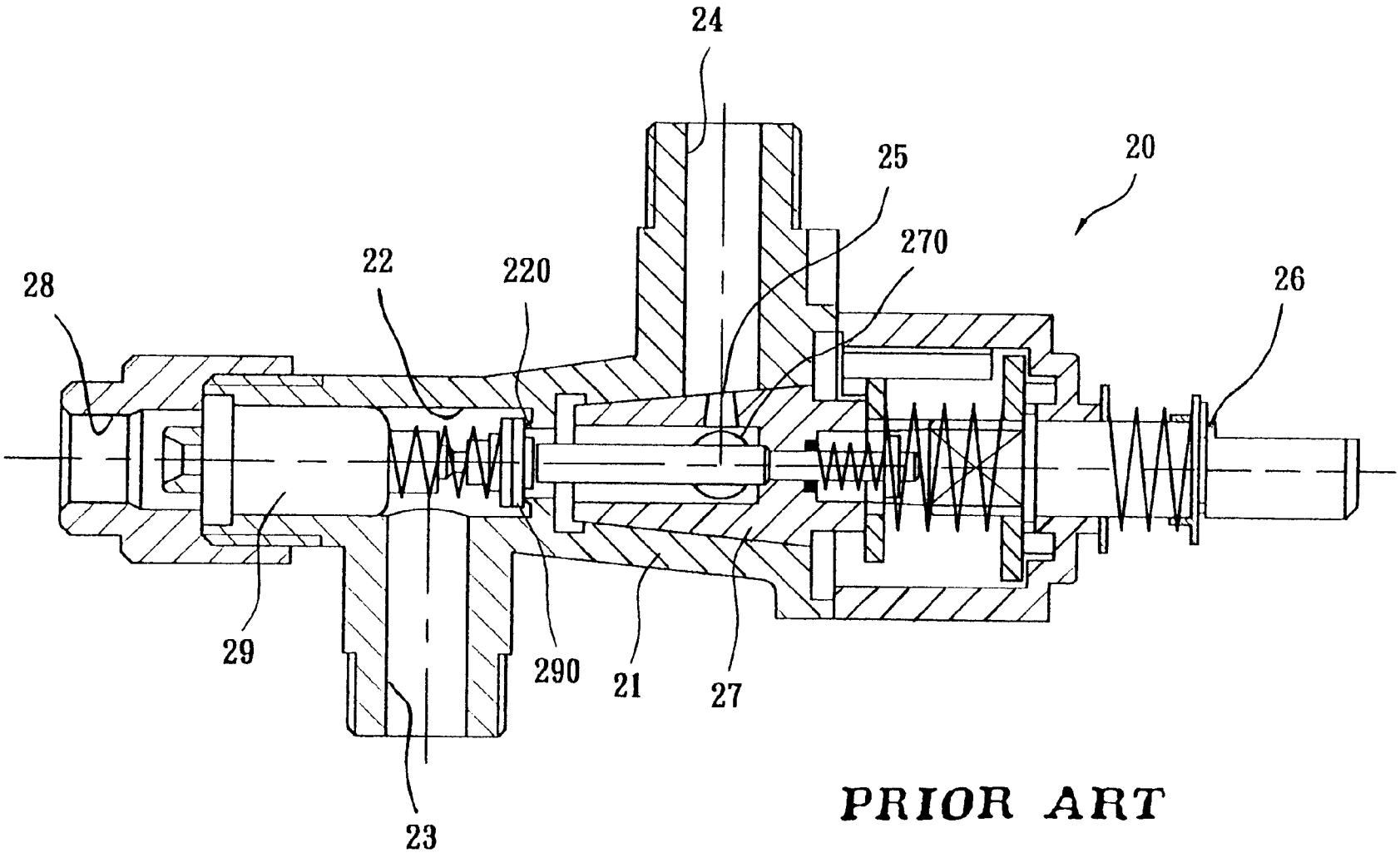
PRIOR ART FIG. 2
FIG. 2 is a sectional view of the interior of the conventional switch.
Figure 3:
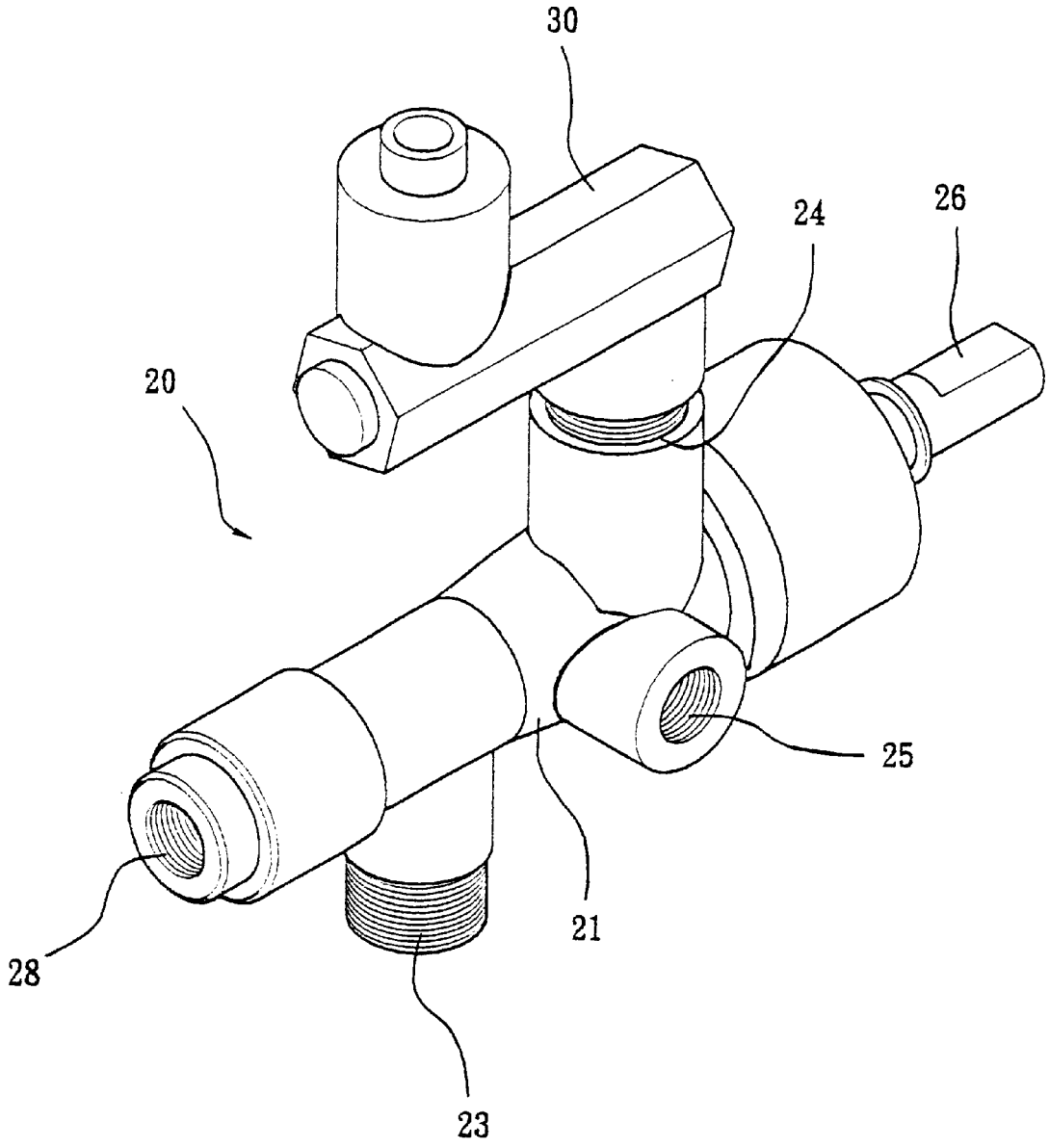
PRIOR ART FIG. 3
FIG. 3 is a perspective view of the conventional switch mounted with a conversion head.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 4:
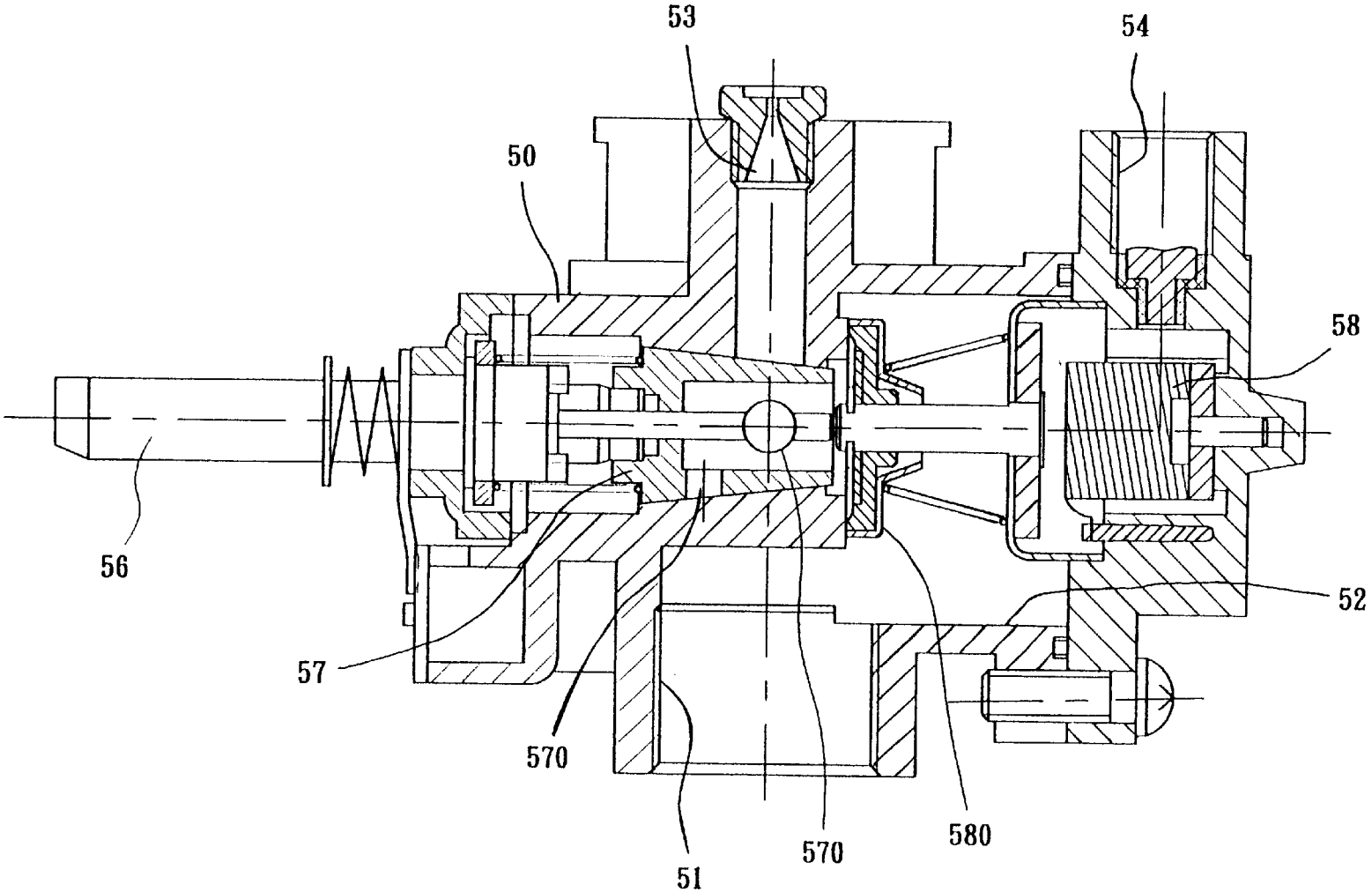
FIG. 4 is a sectional view of the switch of the present invention.
Figure 5:
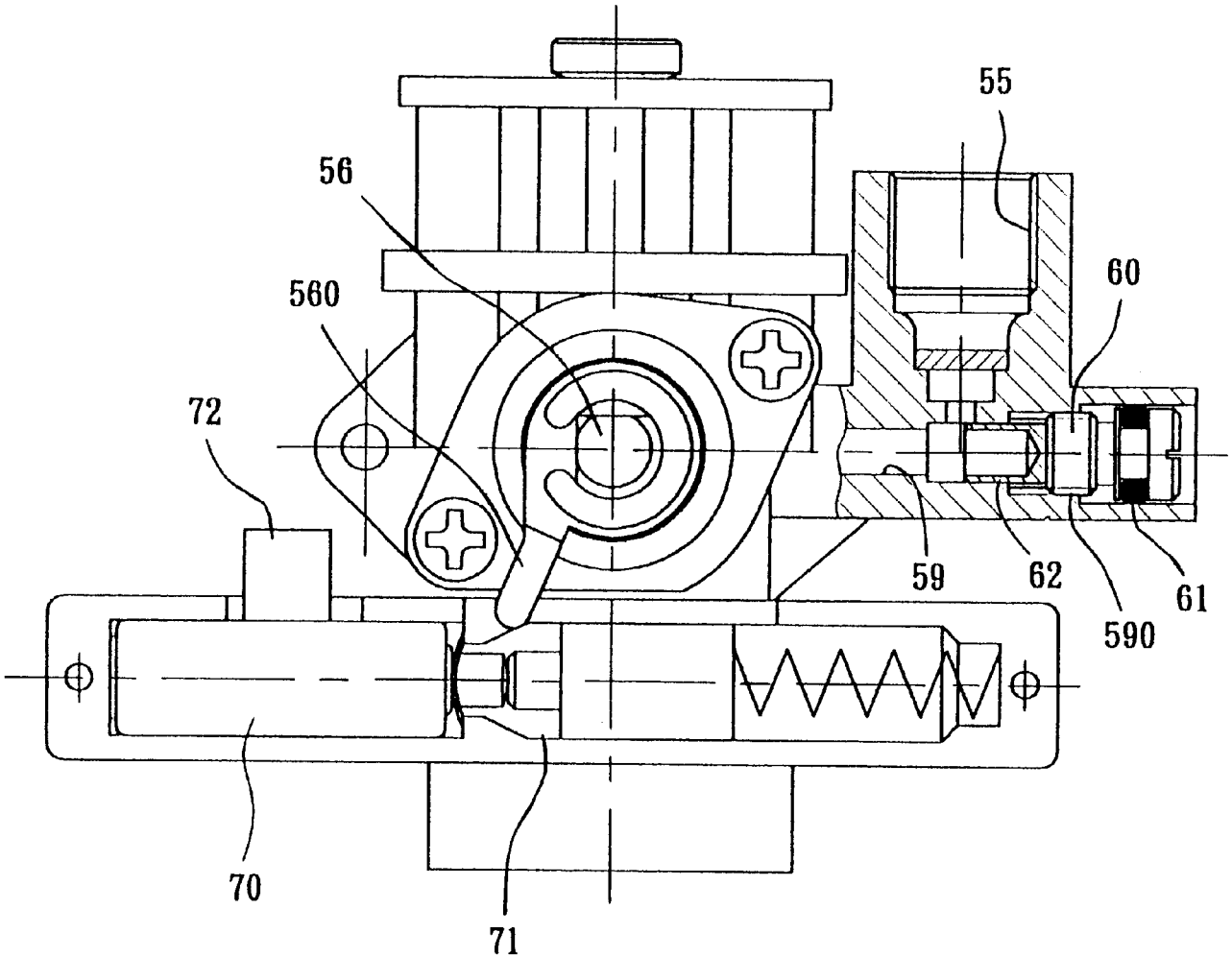
FIG. 5 is a sectional view of an enlarged portion on one portion of the present invention.
Figure 6:
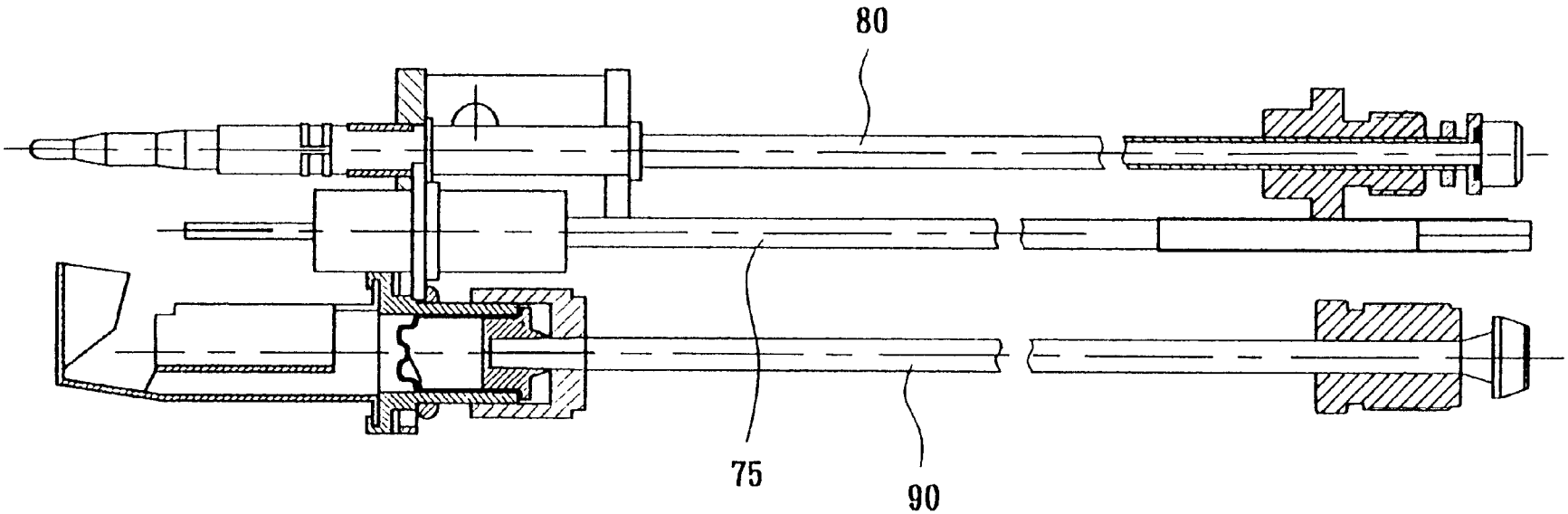
FIG. 6 is a schematic view of the second flame tube, the lighter, and the thermocouple in accordance with the present invention.

Referring to FIGS. 4 and 5, there is shown a switch structure for a heating device. The interior of the main body 50 has a passage 52 and an air inlet 51 a main flame air outlet 53, a second flame air outlet 55 which is connected to the passage 52, and a thermocouple insertion hole 54 is also provided at the main body 50. The interior of the passage 52 is mounted with a manual control rod 56 on which is arranged a stopper 57. On the stopper 57, there are two through holes 570 corresponding to the main flame air outlet 53 and the second flame air outlet 55. The interior of the thermocouple insertion hole 54 is provided with an electromagnetic valve 58 having a plug body 580. The plug 580 is suited to cut off the passage 52 from the air inlet 51 to air outlet 53 and the second flame outlet 55. The middle section of the manual control rod 56 is extended downward to a triggering rod 560 and the triggering rod 560 is suited to urge at the impact needle 71 of a lighter 70. As shown in FIG. 6, the socket 72 of the lighter 70 is provided with a lighting rod 75. The thermocouple on hole 54 and the second flame air outlet 55 are provided with the thermocouple 80 and the second flame air tube 90 such that when the user presses down are rotates the manual control rod 56, the plug body 580 of the electro-magnetic valve 58 is pushed to open, and gas passes through from the passage 52 and the through hole 570 to the main flame air outlet 53 and the second flame air outlet 55. At the same time, the rotating of the manual control rod 56 causes the triggering rod 560 to push the impact needle 71, such that the impact needle 71 is reflected to impact the lighting rod 75 of the lighter 70, and lights the gas from the second flame air tube 90 to heat the thermocouple 80. The electro-magnetic valve 58 attracts the plug body 580, and gas is continuously supplied to the burner of the main flame air inlet 53.

Referring to FIGS. 4,and 5, the flame air outlet 53, the thermocouple insertion hole 54 and the second flame air outlet 55 are opened upward and all are of similar direction. The main flame air outlet 53 and the air inlet 51 are on the same axis, and the stopper 57 is suitably positioned in between the main flame air outlet 53 and the air inlet 51, such that the lighting rod 75, the thermocouple 80 and the second flame air tube 90 are extended in the same direction and are mounted thereto, as shown in FIG. 6.

Figure 7:
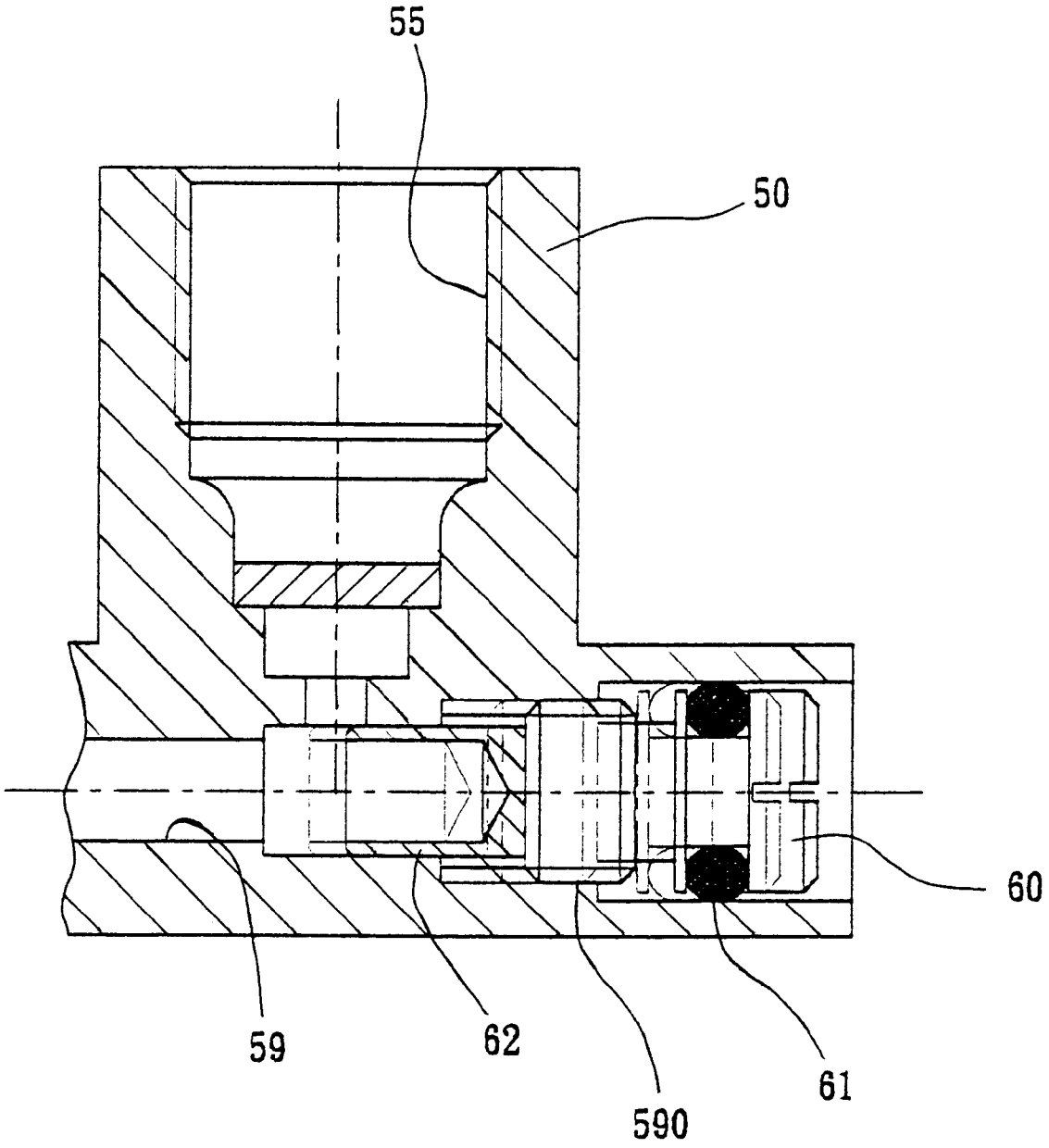
FIG. 7 is a schematic view of the second flame adjusting structure of the present invention.

Referring to FIG. 7 a guiding hole 59 is formed between the passage 52 and the second flame air outlet 55. The guiding hole 59 is provided with the internal screw threads 590 for the mounting with an adjusting screw 60. A sealing element 61 is provided to the adjusting screw 60 so as to provide a sealing effect. The adjusting screw 60, corresponding to the second flame air outlet 55, is provided with a cylindrical plug 62 such that when the user turns the adjusting screw 60, the size of venting of the second flame air outlet 55 can be controlled.

In view of the above, in practice, the following advantages are obtained:

(1) Easy to assemble

As the direction of the openings of the main flame outlet 53, the second flame air outlet 55 and the thermocouple insertion hole 54 are of same direction, the lighting rod 75, the t couple 80 and the second flame air tube 90 arc directly mounted without using a curved conduit. Besides, the air inlet 51 and the main flame outlet 53 are located on the same axis, no conversion connector is required. Thus the assembly operation is simple and easier.

(2) Smooth Passage

In view of the above, the main flame air outlet and the air inlet being on the same axis, this will improve the smoothness of gas flow, and the burning in of gas is complete. Therefore, the safety of application is greatly enhanced.

(3) Lower cost of production

As the assembly operation is easy, time taken for the assemble operation is sorter and therefore, the required cost of production is greatly reduced.

(4) High stability

As the various air holes have opening of similar directions, the weight center of the gas heating device a the pipes have been fitted, the cost on the additional conversion connector and the soft pipes are not required, and these will not affect the weight center of the entire heater. The stability of the present invention is far higher than that of the conventional invention.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spit of the present invention.

I claim:

1. A switch structure for a heating device having a passage formed within the main body of the structure, an air inlet, a main flame air outlet, a second air outlet and a thermocouple insertion hole connected to the passage being formed on the main body, and a manual control rod having a stopper being provided within the passage of the main body, two through holes being formed corresponding to the main flame air outlet and the second flame air outlet; characterized in that the main flame air outlet, the thermocouple insertion hole and the second flame air outlet have upward direction openings of similar direction, and the main flame air outlet and the air inlet are located on the same axis, and the stopper is suitably mounted between the main flame outlet and the air inlet, thereby a lighting rod of the switch, the thermocouple and a second air tube are extended in same direction to form an easy to assemble, safe and stable switch for the heater.

2. The switch structure for a heater as set forth in claim 1, wherein a guiding hole with screw threads is formed between the main passage and the second flame air outlet, and the guiding hole is locked by a screw having a sealing element, and an adjusting screw, corresponding to the second flame air outlet, is provided with a cylindrical plug for the controlling of the size of the second flame.

* * * * *